United States Patent [19]

Wainwright et al.

[11] 4,353,139

[45] Oct. 12, 1982

[54] PROTECTIVE COVER FOR INDIVIDUAL WATER FIXTURES

[76] Inventors: Richard M. Wainwright, P.O. Box 541, Dennis, Mass. 02638; Steven Wilson, 14 Elisha's La., Yarmouthport, Mass. 02675

[21] Appl. No.: 110,918

[22] Filed: Jan. 10, 1980

[51] Int. Cl.[3] ..... A47K 17/00

[52] U.S. Cl. ..... 4/661; 4/DIG. 18; 239/602; D23/32; D23/36

[58] Field of Search ..... 4/661, DIG. 18; D23/32, D23/36; 239/602

[56] References Cited

U.S. PATENT DOCUMENTS

| | | | |
|---|---|---|---|
| 2,876,471 | 3/1959 | Kraemer | 4/DIG. 18 |
| 3,129,894 | 4/1964 | Scharmarhorn | 239/602 |
| 3,199,121 | 8/1965 | Greto | 4/DIG. 18 |

*Primary Examiner*—Henry K. Artis
*Attorney, Agent, or Firm*—Pearson & Pearson

[57] ABSTRACT

A protective cover entirely of soft, deformable, cushioning material such as high density, closed cell foam rubber or plastic is of elongated, hollow tubular configuration with an outer imperforate, closed end, a cylindrical side wall, and an inner open end so that it may be sleeved over a water spout projecting over a bathtub to cushion the user in case of accidental contact or fall. The bottom of the cover is closed except for a water discharge opening in the cylindrical side wall near the closed end, for the passage of water from the spout tip. The closed end is extra thick and shaped as an animal head to appeal to youngsters. The bottom of the cylindrical side wall is longitudinally split to permit expansion over a spout.

6 Claims, 7 Drawing Figures

PROTECTIVE COVER FOR INDIVIDUAL WATER FIXTURES

BACKGROUND OF THE INVENTION

It has heretofore been proposed to provide a continuous cushion strip around the rim of a bathtub, and a chambered cushion strip over a valve handle of a bathtub, as in U.S. Pat. No. 2,152,968 to Monge with an outer layer of Apr. 4, 1939.

It has also been proposed to make a one piece cover of cushion material which encloses both the water spout and valve handles of a bathtub as in U.S. Pat. No. 3,199,121 of Aug. 10, 1965 to Greto.

In U.S. Pat. No. 2,853,714 to Darmstadt of Sept. 30, 1958 a cover which encloses the entire bathtub during installation of the bathroom and building of a house is proposed.

SUMMARY OF THE INVENTION

In this invention, the entire tub is not cushioned with a lining, nor is the rim alone, nor is there a relatively unwieldy, unattractive cushion cover over both handles and spout so that they cannot be seen individually.

Instead, a cover is provided for each individual water fixture, which protrudes from the wall to overhang a bathtub, bathroom, or kitchen sink or the like, the individual covers being elongated to entirely enclose an elongated spout, but being usable over a handle also, especially, if cuffed.

The elongated individual water fixture cover of the invention is preferably hollow cylindrical, or hollow tubular with uniform inside dimensions or diameter a cushioned closed outer end and an open inner end so that it can be sleeved over a spout for the full length thereof. An opening for passage of water from the tip of the spout is provided near the closed end of the hollow tubular body, and in the bottom of the cylindrical side wall thereof.

The outer imperforate end of the hollow tubular body, or cover, is closed and preferably is of extra thick cushion material configured into three dimensional shape to depict the head of an animal so that the remainder of the cover appears to be the animal body.

The cover may be one piece and unitary, it may be an enlarged animal head portion adhered or fused to a tubular body of reduced dimensions, or it may be longitudinally split and connected across the longitudinal split by an adhesive, fusing, snap fasteners, "Velcro" or any other suitable way.

DESCRIPTION OF A PREFERRED EMBODIMENT

Figure 1:
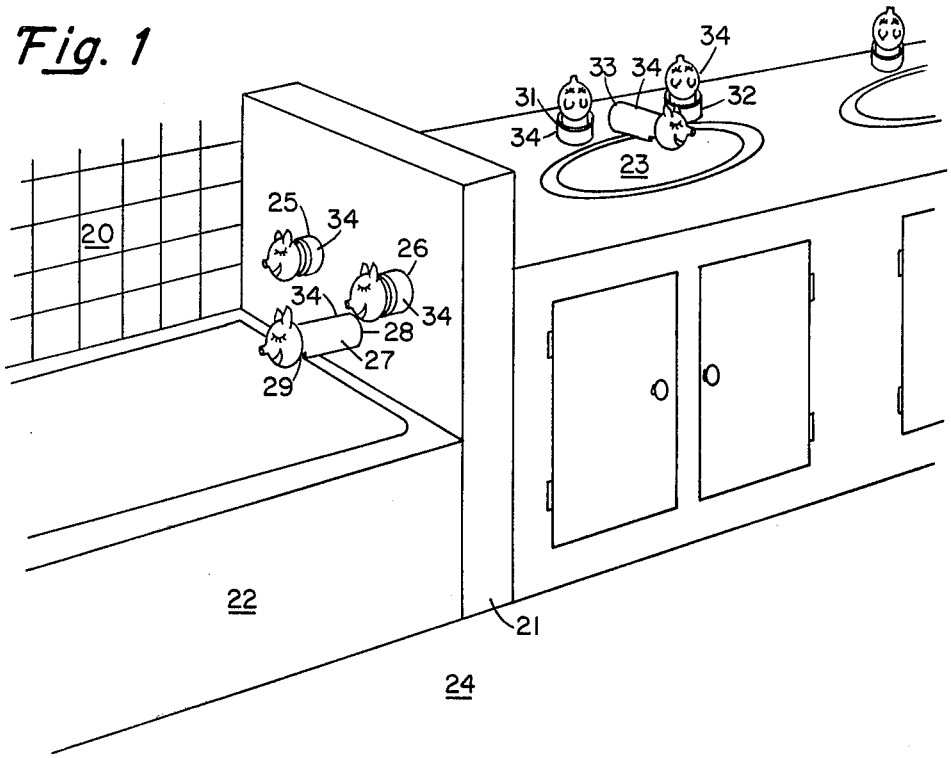
FIG. 1 is a perspective view showing the individual spout covers of the invention in use in a bathroom.

In FIG. 1 a typical bathroom is shown having walls 20, a partition 21, bathtub 22, bathroom sink 23 and floor 24. Hot water valve handle 25 and cold water valve handle 26 project from partition 21 over the bathtub 22 and water spout 27 projects from its base 28 from the tub 22 to its tip 29 usually about five inches.

A similar hot water handle 31, cold water handle 32, and water spout 33 is provided for bathroom sink 23.

As best shown in FIGS. 2–6, in its preferred embodiment the removable, individual, protective cover 34 of the invention includes an elongated hollow tubular body 35 entirely of soft deformable cushion material 36 which material is preferably high density, closed cellular, foam rubber or plastic of predetermined thickness such as one half inch or more.

The side wall 30 of cover 34 is preferably, substantially, hollow cylindrical, with inside dimensions, or diameter, uniform and about equal to the outside dimensions of the base 28 of the spout which is usually about two inches. It extends about five inches longitudinally from the open end 37 to the closed opposite end 38 and the outside surface 39 is preferably uniform in diameter although it may be textured, configured, colored or otherwise made more attractive by shape to its user.

The cover 34 is thus substantially equal in length to, or greater in length than, the length of the spout 27 to wholly enclose the spout when the open end 37 is sleeved over the spout.

Figure 7:
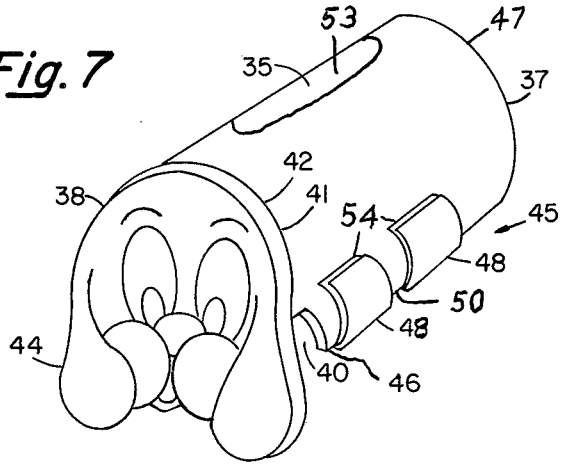
FIG. 7 is a perspective view of an individual spout cover of the invention with a flat planar front face and a longitudinal split.

The closed end 38 may be one piece and unitary with the body 35 or it may be a separate piece adhered to the rim 41 of body 35 by a layer of adhesive 42, by fusing, interlocking parts, or the like, the adhesive being shown in FIG. 7.

Figure 2:
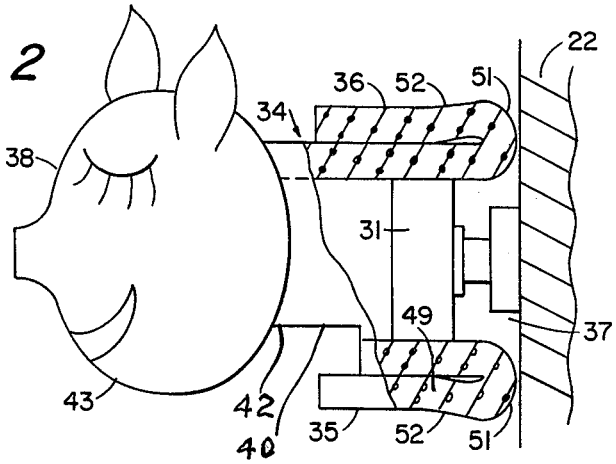
FIG. 2 is an enlarged fragmentary side elevation showing an individual spout cover cuffed to cover a handle.
Figure 3:
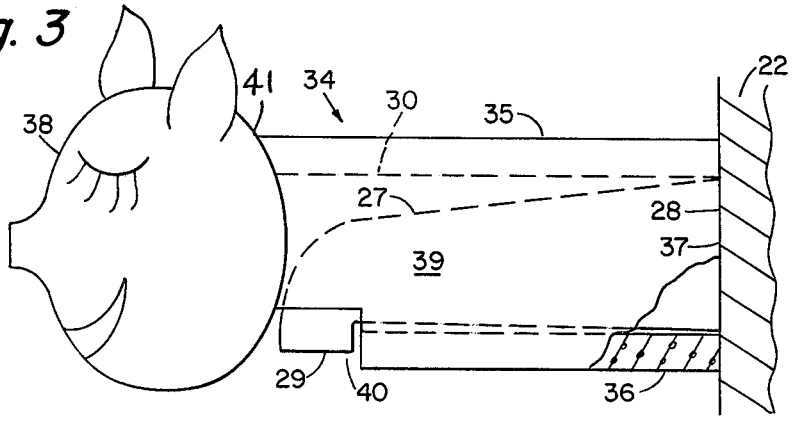
FIG. 3 is a view similar to FIG. 2 showing an individual spout cover of the invention sleeved over a spout.
Figure 4:
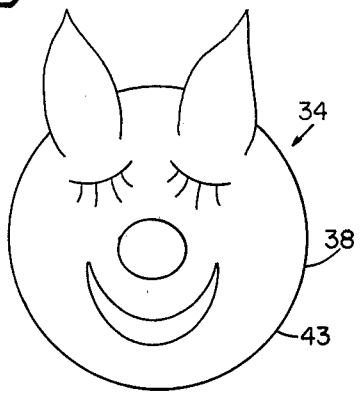
FIG. 4 is a front elevation.
Figure 5:
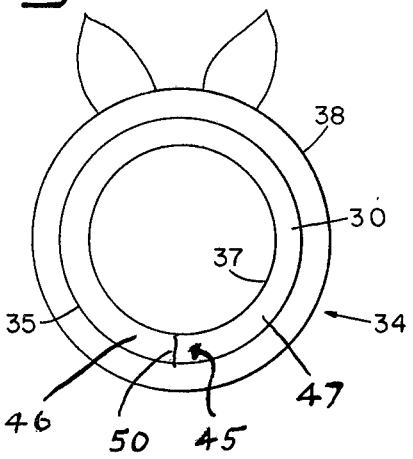
FIG. 5 is a rear elevation of the cover shown in FIG. 3.
Figure 6:
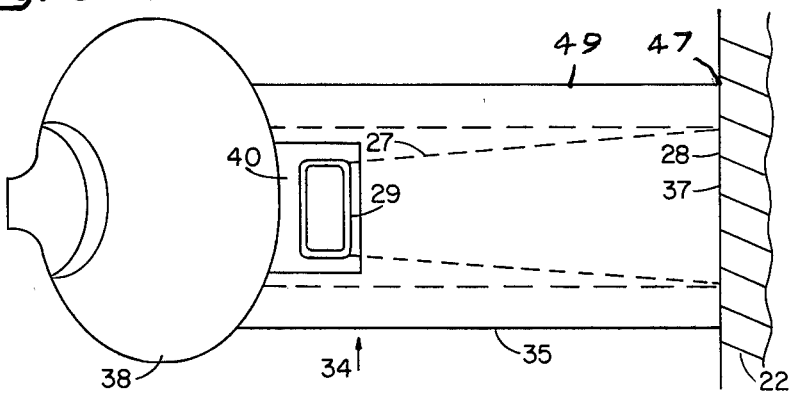
FIG. 6 is a bottom plan view of the cover shown in FIG. 3.

Each individual cover 34 includes an opening 40 in the bottom thereof, proximate the closed end 38, for the passage of water from the tip 29 of the spout 27 into the bathtub 22 or sink 23. As shown in FIGS. 2, 3, and 6 the opening 40 is of greater dimensions than the dimensions of tip 29 and loosely fits therearound.

The body 35 is of predetermined thickness of material 36, selected to possess sufficient cushioning against impact to avoid danger to the human body in case of a fall, or to prevent burn if the hot handle or spout is approached by a child. Preferably the closed end 38 is of substantially increased thickness such as an inch or two inches to better cushion the spout or handle. It preferably is also configured in three dimensions to resemble an animal head, such as the pigs head 43, or a rabbit, elephant, dog, mouse or the like, with the body 35 appearing to be the body of the animal. However, the closed end 38 may also have a flat planar outer face 44 for the reception of the representation of an animal head, or for advertising messages, or other desired indicia.

While the cover 34 with its tubular body and imperforate closed end may be formed of one piece of foam cushion material 36, it may also be longitudinally split as at 50, preferably at the bottom 46 of the cover. The split 50 extends from the opening 40 to the inner rim 47 of the cover 34 and may be closed by fastening means 45 such as fusing of the plastic material, or by a layer of adhesive 42, or by the pair 54 of longitudinally spaced, laterally extending hook and pile tapes of "Velcro" 48 as shown in FIG. 7.

The material 36 of the cover 34 is of predetermined deformability and resilient quality to enable the inner end portion 49 to be turned back upon itself as at 51 to form the exterior cuff 52 so that it will fit over the handles 25, 26, 32 or 33 in cuff form as shown in FIG. 2.

The protective cover 34 is preferably a relatively close fit around a spout, or handle, to remain in place by friction. It may support a washcloth on its exterior without the slippage of a metal spout and the cover may have a soap dish recess 53 in the exterior surface 39 as in FIG. 7, or the recess may be in the closed end as part of the animal head design.

We claim:

1. A removable protective cover for each individual water control handle or spout projecting from a wall, bathtub, or sink in position to hurt the user by accidental contact, said cover comprising:

an elongated tubular body, entirely of soft, deformable, cushion material, said body having a hollow cylindrical side wall of uniform outside diameter, or uniform inside diameter substantially equal to the outside diameter of a typical spout, and of predetermined length slightly greater than the length of said typical spout;

said body having one end open for slidable sleeving over said spout and having an opposite, closed imperforate end of said cushion material, enlarged to greater dimensions than the outside diameter of said cylindrical side wall to cushion the tip of said spout;

and the hollow cylindrical side wall of said body being longitudinally split along its bottom from said open end to said closed end with a water emission aperture in the bottom of said side wall and forming part of said slit, said aperture being of predetermined dimensions to loosely fit around the downturned tip of said spout;

said cover wholly enclosing an individual, projecting, water control, handle or spout, to cushion the same against human impact from any direction.

2. A removable, longitudinally split, tubular cover as specified in claim 1 plus:

at least one fastening tape extending across said split, from one portion of said hollow bylindrical sidewall to the opposite portion thereof, to securely fasten said cover to a bathtub spout.

3. A removable, longitudinally split, tubular cover as specified in claim 1 wherein:

said soft deformable cushion material is high density, closed cell foam rubber, or foam plastic, of uniform thickness of one half inch or more.

4. A removable, longitudinally split, tubular cover as specified in claim 1, wherein:

said body is formed of high density, closed cell foam rubber, or foam plastic, said side wall being of uniform thickness of one half inch or more and said closed, imperforate end wall of enlarged dimensions being of substantially greater thickness than said side wall.

5. A removable, longitudinally split, tubular, cover as specified in claim 1 wherein:

the material of said side wall is turned back outwardly upon itself to form an exterior cuff at the base of said cover, thereby fitting around a projecting handle.

6. A removable, longitudinally split, tubular cover as specified in claim 1 wherein:

said opposite, closed, imperforate end of said body, enlarged to greater dimensions than the outside diameter of said cylindrical side wall, is also of substantially greater thickness of said soft, deformable, cushion material and is configured into the shape of an animal head so that said cylindrical body appears to be the body of said animal.

* * * * *